United States Patent [19]

Tate

[11] Patent Number: 4,635,810

[45] Date of Patent: Jan. 13, 1987

[54] CARDBOARD BOX AND/OR PLASTIC CRATE PARTITION

[76] Inventor: Benjamin E. Tate, 407 Wedgewood Dr., Erie, Pa. 16505

[21] Appl. No.: 797,045

[22] Filed: Nov. 12, 1985

[51] Int. Cl.[4] ..... B65D 5/48

[52] U.S. Cl. ..... 220/21; 220/22; 206/427; 229/15

[58] Field of Search ..... 220/22, 21; 229/28 R, 229/28 BC, 15; 206/427, 431, 433

[56] References Cited

U.S. PATENT DOCUMENTS

| | | | |
|---|---|---|---|
| 3,341,054 | 9/1967 | Hirota | 220/21 |
| 3,750,929 | 8/1973 | Flanagan | 206/427 X |
| 4,000,845 | 1/1977 | Zeller | 229/15 |
| 4,194,675 | 3/1980 | Peters, Jr. | 229/15 |
| 4,499,997 | 2/1985 | Swingley, Jr. | 220/21 X |

*Primary Examiner*—Steven M. Pollard

*Attorney, Agent, or Firm*—Charles L. Lovercheck; Wayne L. Lovercheck; Dale R. Lovercheck

[57] ABSTRACT

A cardboard box and/or plastic crate partition is disclosed, made up of longitudinal and lateral partition members that are substantially flat and that are substantially identical but for the different lengths for forming lateral and longitudinal partition members. The partition members each have slots that extend about half way across them. These slots in the partition members extend in one direction, receive the partition members extending in the other direction. Shoulders on the partition members of one direction overlie the slots and prevent the partitions from separating from each other.

1 Claim, 7 Drawing Figures

CARDBOARD BOX AND/OR PLASTIC CRATE PARTITION

STATEMENT OF THE INVENTION

There is a need for a simple, efficient and economical partition for use in boxes or crates made of cardboard or plastic which can be economically produced and efficiently assembled and used. The partition according to the invention may be made flat and quickly assembled.

BACKGROUND OF THE INVENTION

The box or crate is disclosed with a plastic partition in a box or crate. This type of cardboard box and/or plastic crate partition according to usual practice requires expensive tools and dies to manufacture and requires considerable space for shipment and storage. Applicant's plastic partition can be assembled and shaped as flat plate-like pieces having all necessary die cut slots, holes and shoulders therein. The flat plate like pieces can be stacked compactly and shipped economically.

The particular slot, hole, bead and shoulder arrangement of the present invention coupled with the fact that the longitudinal and lateral partition members are identical, except for length, provides a simple and economical structure for protecting bottles, can and the like from damage.

OBJECTS OF THE INVENTION

It is an object of the invention to provide an improved partition arrangement in a bottle carrying box, be it cardboard or plastic.

Another object of the invention is to provide a box or crate of cardboard or plastic partition that it simple in construction, economical to manufacture and simple and efficient to use.

Another object of the invention is to provide a partition unit for a cardboard box and/or plastic crate which can be extruded, die cut, stored and shipped flat and assembled into a bottle cardboard box and/or plastic crate partition.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
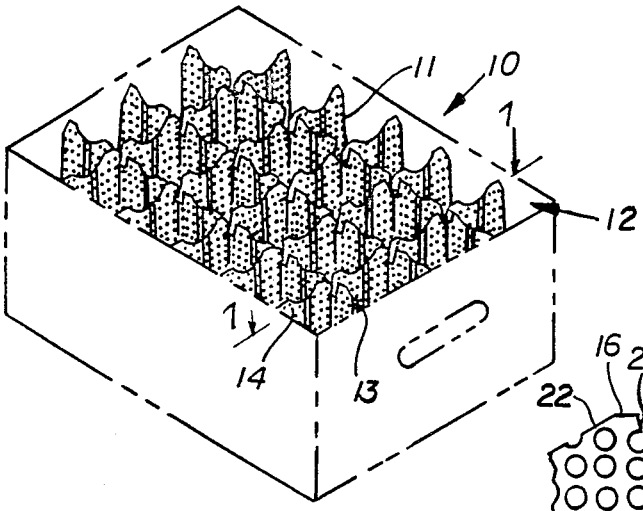
FIG. 1 is an isometric view of the partition according to the invention.
Figure 7:
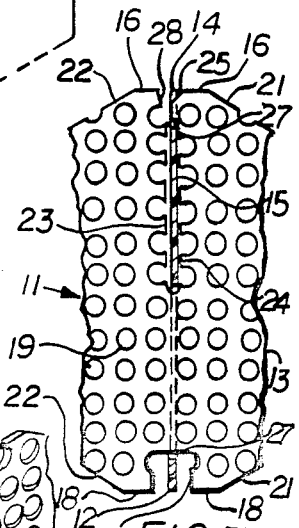
FIG. 7 is a partial cross sectional view of FIG. 4.

Now with more particular reference to the drawings, I show a cardboard box and/or plastic crate 12 which can be made of cardboard, plastic or other suitable material. The box, crate, or carton may be used for beer bottles or the like and may be made of any suitable material. The boxes typically have a partition 11 therein. The partition 11 is made up of longitudinal cross members 13 and lateral cross members 14 that provide an array of bottle receiving compartments. The partition members 13 and 14 are substantially identical but are of different lengths to accommodate the length and width of a particular cardboard box and/or plastic crate 12 and the partition members 13 are inverted relative to the partition member 14.

Each partition member 13 and 14 has a first side 16 made up of flat surfaces adapted to rest on a container bottom and a second side 18 made up of flat surfaces adapted to be spaced above the bottom of a container. The spaced slots 15 are formed in the first side 16 and extend downwardly toward the second side 18 and terminate approximately halfway between the two sides.

Figure 2:
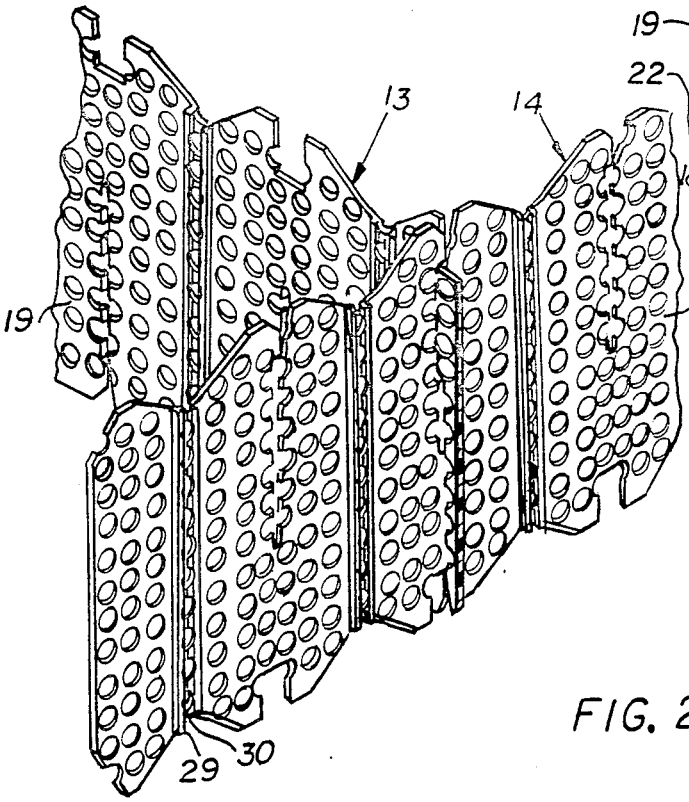
FIG. 2 is an enlarged partial side view of one of the partition members shown in FIG. 1.
Figures 3, 4, 5, 6:
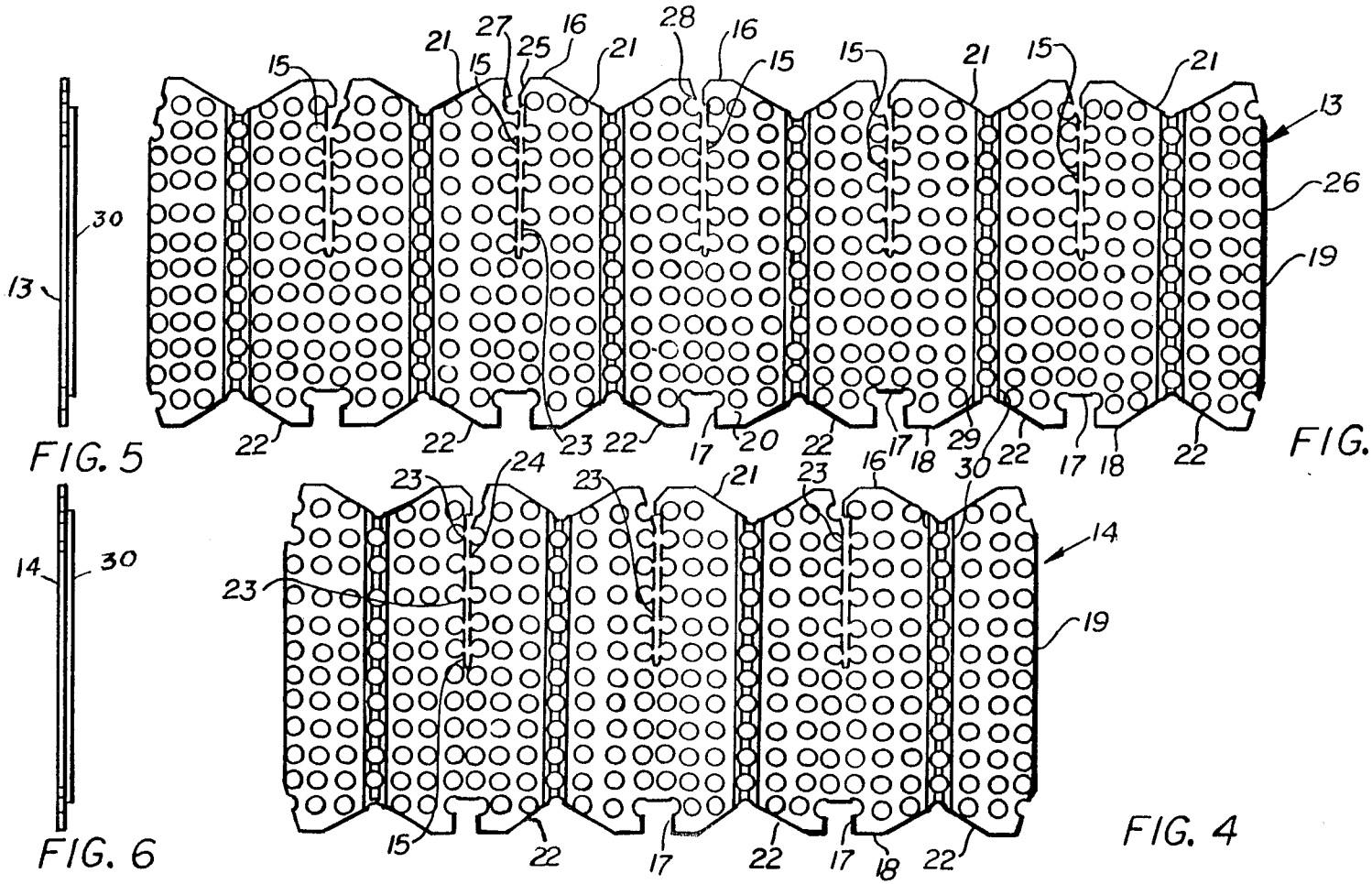
FIG. 3 is a side view of one of the partition members of the partition shown in FIGS. 1 and 2.
FIG. 4 is a side view of another partition section as shown in FIGS. 1 and 2.
FIG. 5 is an end view of FIG. 3.
FIG. 6 is an enlarged partial end view of FIG. 2.

The partition members 13 and 14 may be made by extruding suitable sheets of thermo-plastic material with spaced beads 30 running the length of the sheet. The partition member of the configuration shown is then die cut from the sheet. The configuration cut includes a shoulder portion 27 formed adjacent the first side 16 and this shoulder portion 27 overlies the bottom of the slots 15 in the second partition members 14 when the partition members are assembled as in FIGS. 1 and 2. The shoulders extend from first side 23 of the slot 15 toward the second side 24 of the slot 15. Each of the first slots have a first side 23 and a second side 24. The first inclined part 28 of the second side of the slot extends from the first side 16 toward the second side 18 and is indicated at 28. The inclined surface 28 makes a convenient guiding surface to guide the second partition member 14 down into the slot 15 of the partition member 13.

The partition members 13 and 14 each have the convoluted side portions 21 and 22 which provide a non-continuous bottom engaging part 18 so that the partition members will rest firmly on the bottom of the cardboard box or plastic crate 12 irrespective of small irregularities.

Holes 19 are disposed in symetrical rows over the entire partition in each of the partition members 13 and 14 which reduce the weight of the sections and reduces the amount of plastic materials necessary to form the partition members and to reduce their weight.

The grooves 17 are considerably wider than the slots 15 in order to compensate for any distortion in the partitions when they are installed in the cardboard box or plastic crate. The inclined surfaces 25 and 28 converge into slots 15 and make it much easier for making the partition to enter the slot during assembly of the partition members. The convolutions 21 and 22 add to the stability of the partition members and define the spaced flat surfaces on sides 18.

Two spaced ribs or beads 30 will be extruded on the partition between each two convolutions 21 and 22. When the partitions are assembled as in FIG. 1 the ribs will be spaced to provide spacers to avoid damage to labels over bottles of beer or other materials and to provide an air space to allow the bottles to dry. The ribs will be midway between slots 15 with the shoulders 27 of the partition member 13 overlying the bottom of notches 17 of partition member 14 locking the longitudinal member 13 in rigid relation with lateral member 14. A relatively rigid partition insert is formed which is nearly as rigid as an integrally molded partition.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a cardboard box and/or plastic crate having a bottom and a partition made of thermoplastic material in said crate, said partition comprising a first partition members and a second partition members, said first partition members and said second partition members each being substantially identical to the other in configuration, said first partition members and said second partition members each having a first side and a second side and spaced generally V-shaped convolutions formed in said first sides and in said second sides, said sides being flattened between said convolutions providing a supporting surface to rest on said bottom, said partition members each comprising a plate like member having first sides and second sides having spaced pairs of spaced beads extending from said first side toward said second side, said plate-like members having spaced first slots formed in said plate and extending from a first side, toward a said second side, second slots formed in each said partition and extending from second sides toward said front side and extending from the bottom of each said convolution on one said side to the bottom of each said convolution on the other said side, said first slots each having a first side, and a second side, said first sides of each said first slots adjacent said first edge of each said partition member extending inwardly toward said second edge, then at right angles toward said second edge defining a shoulder, said first slots having second sides extending from said first edges toward a second side and toward said first end underlying said shoulders, then extending toward said second edge to a position beyond the center part of said partition member toward said second edge and terminating at an inner end, said first slots in said first partition member receiving said second partition member between the inner ends of said first slots and said second slots, said shoulder overlying said second partition in said second slots whereby said shoulders lock said partition members together, each said pair of said beads being disposed approximately half way between two adjacent said first slots for preventing damage to labels on bottles that may be disposed adjacent said partitions, said partition has six spaced rows of relatively large holes extending through said plate-like partition member and disposed between each said pairs of spaced beads.

* * * * *